United States Patent [19]

Onoda et al.

[11] Patent Number: 4,578,978

[45] Date of Patent: Apr. 1, 1986

[54] ROLL FORMING APPARATUS

[75] Inventors: Yoshitomi Onoda, Kofu; Masami Ishii, Toyota; Hitoshi Sugimoto, Nagoya; Mitsuhiro Ozawa, Hekinan, all of Japan

[73] Assignee: Aisin Seiki Kabushiki Kaisha, Kariya, Japan

[21] Appl. No.: 606,478

[22] Filed: May 3, 1984

[30] Foreign Application Priority Data

May 4, 1983 [JP] Japan ..... 58-78429

[51] Int. Cl.[4] ..... B21D 5/08

[52] U.S. Cl. ..... 72/181; 72/179

[58] Field of Search ..... 72/176, 179, 181, 183, 72/182

[56] References Cited

U.S. PATENT DOCUMENTS 3,344,641 10/1967 Pomory ..... 72/179

3,462,989 8/1969 Fischer, Jr. ..... 72/181

*Primary Examiner*—W. D. Bray

*Attorney, Agent, or Firm*—Oblon, Fisher, Spivak, McClelland & Maier

[57] ABSTRACT

A roll forming apparatus for forming a flat strip material into a channel shape. This apparatus is composed of a first driving station, a second driving station, and at least two forming stations disposed between the both driving stations. Each driving station respectively contains a pair of driving rolls. The driving rolls of the second driving station is thus constructed to pull the strip at the higher speed than those of the first driving station. Therefore, to the portion of the strip between the first and second driving stations is applied a tensile stress while the strip is sent to the second driving station from the first driving station. At least two forming stations are disposed and respectively contain a pair of forming rolls which are rotated by the moving strip. At the same time, the strip is formed by the forming rolls. As the forming roll used in the present apparatus is a driven roll, maintenance such as adjusting the rotating speed of each station is not necessary. Also insofar as uniform tensile stress is applied to the strip while forming, the resulted strip seldom has an abnormal deformation or twisting. Thus a formed product with high dimensional accuracy can be obtained.

5 Claims, 12 Drawing Figures

ROLL FORMING APPARATUS

BACKGROUND OF THE INVENTION

1. Field of the Invention

This invention relates to an improvement of a roll forming apparatus.

2. Description of the Prior Art

With respect to a roll forming apparatus to form a flat strip material into a channel form, such apparatus has been known as disclosed in Japanese Patent Application No. 128618/1981. In this conventional apparatus, the flat strip passes through a series of plural forming stations to have a channel shape. More particularly, the flat strip is disposed between a pair of forming rolls of each station, to thereby deform the cross sectional shape of the flat strip to be of a U-shape or V-shape in accordance with the shape of the outer surface of the forming rolls. In this apparatus, the forming rolls used at each station respectively drive the strip by means of a driving motor. Therefore the rotating speed of each of the forming rolls at each driven station must be a constant speed. When the rotating speed of the forming rolls of the respective station are different each other, such problems as, for example the deformation or twisting of the strip is caused at a respective station because different tensil stresses are applied to various portions of the strip.

SUMMARY OF THE INVENTION

The primary object of the present invention is to provide a simplified roll forming apparatus which does not require adjustment each speed at a plurality of forming stations.

Another object of the present invention is to provide a roll forming apparatus without causing an abnormal deformation of the strip such as twisting or bending.

In the apparatus of the present invention, the flat strip is disposed between a first driving station fixed on a base and a second driving station fixed on the base wherein the pulling speed generated by the second driving station is higher than that of the first station so as to apply an uniform tensile stress to the portion of the strip between the first and second stations. In this state, a plurality of forming stations being settled on the base are disposed between the first and second station. Each pair of forming rolls of the respective forming station is driven by the strip thereby forming the flat strip into a shape with an uniform cross section in accordance with the forming rolls. Preferably at least two forming stations should be set, and the utilization of more forming stations is preferable.

The distortion applied between the first and second driven station should be within the elastic deformation of the flat strip. When a large forming resistance may be caused by the many forming stations, the number of forming stations utilized should be reduced. When the required forming can not be finished between the two driving stations, a third or even more driving stations may be disposed with the plural forming stations wherein the strip may be formed respectively. The pair of rolls of the driving station may form the strip as well as pull the strip.

Each forming station contains a pair of forming rolls. One of the two forming rolls may have a anular groove formed around the outer surface and the other forming roll has a projecting portion to interengage the groove.

The rolls usually form the strip to be V-shape or U-shape.

The pair of forming rolls of each forming station are preferably movable with respect to the driving stations in either direction of the vertical, horizonal or oblique direction and each pair of the forming rolls are adjustable according to the shape of the strip for being formed.

These forming stations are divided into two groups. One group is preferably disposed to form one peripheral portion of the strip and the other group is preferably disposed to form the other peripheral portion of the strip. Many kinds of forming stations are preferred to be mounted so that the strip can be formed into various shapes and the most adequate forming station may be selected according to the purpose then placed between the two driving stations.

The pair of the forming rolls of the forming station used for the present roll forming apparatus rotate themselves by moving of the strip disposed between the driving stations, thereby forming the strip. Thus it is not necessary that the rotating speed of forming rolls of each forming station be respectively adjusted. The portion of the strip between the two driving stations is pulled to both sides with an uniform tensile stress. The abnormal deformation or twisting of the strip being formed at the forming station may thus be prevented, resulting in the formed material in the proposed shape which has a high forming accuracy.

A more complete appreciation of the invention and many of the attendant advantages thereof will be readily obtained as the same becomes better understood by reference to the following detailed description when considered in connection with the accompanying drawings, wherein:

DESCRIPTION OF THE PREFERRED EMBODIMENTS

In the following discussion, the invention will be described substantially referring to an embodiment shown in FIGS. 1–7. Numeral 1 shows a base of the roll forming apparatus of the present embodiment; 2, a first driving station; 3, a second driving station; 4, a third driving station and 8, a pinch roll station.

Figure 4:
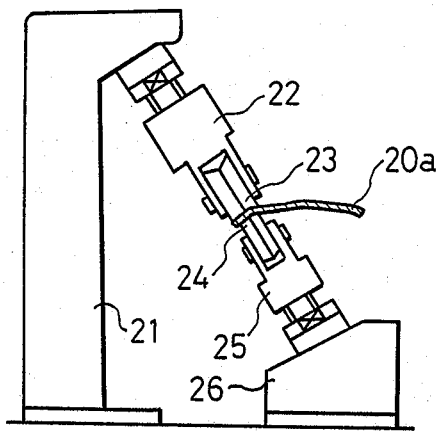
FIG. 4 shows a first forming station which forms the left side of a strip.
Figure 5:
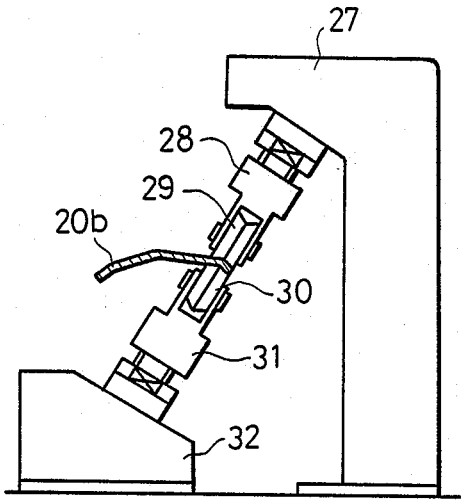
FIG. 5 shows a second forming station which forms the right side of the strip.
Figure 6:
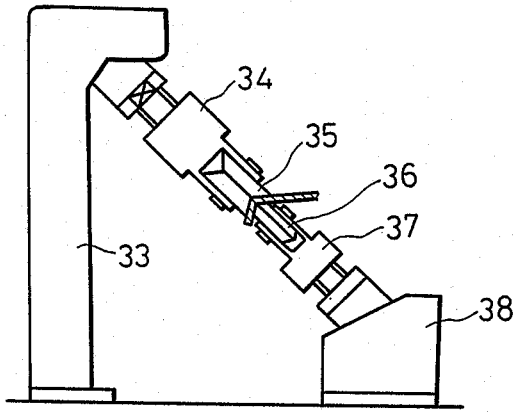
FIG. 6 shows a further forming station.
Figure 7:
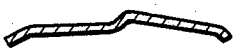
FIG. 7(A) shows a sectional view of the strip formed by the first driving rolls.
FIG. 7(B) shows a sectional view of the strip formed by the rolls of the first forming station group.
FIG. 7(C) shows a sectional view of the strip after finishing.
Figure 7:
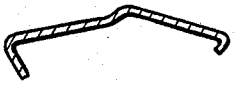
Figure 7:
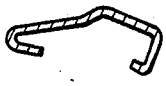

To each of the driving roll stations 2, 3 and 4 are directly connected through an Ordham shaft coupling a driving motor 5, 6 and 7 respectively. Between the first driving station 2 and second driving station 3 is positioned a first forming station group 9, while between the second driving station 3 and third driving station 4, is positioned a second forming station group 10. The first forming group 9 is composed of ten forming stations 9*a*, 9*b*, 9*c*–9*j* which are alternately arranged to the right and left side. Also the second forming group 10 is composed of ten forming stations 10*a*, 10*b*, 10*c*–10*j*, as the same as above. The pinch roll station 8, as shown in FIG. 3(A), has an upper roll 11 and a lower roll 12 with flanges on each side thereof. The rolls 11 and 12 are driven rolls and are rotated by the movement of a strip which is pinched by the rolls 11, 12. The first driving station 2 is mounted to drive an upper roll 13 and a lower roll 14 by means of an electric motor 5 as shown in FIG. 3(B). The forming station 9*a* on the left side is shown in FIG. 4. The forming station 9*a* has an upper stand 21 and a lower stand 26. The upper stand 21 rotatably holds an upper forming roll 23 through a roll holder 22. The lower stand 26 rotatably holds a lower forming roll 24 through a roll holder 25. Both the upper and lower forming rolls 23, 24 are not connected to a driving motor. The forming rolls 23, 23 are driven by the movement of a strip to be formed. The forming station 9*b* on the right side is shown in FIG. 5. The forming station 9*b* has an upper stand 27 and lower stand 32. The upper and lower stands 27, 32 rotatably hold an upper forming roller 29 and a lower forming roll 30 through roll stands 28, 31 respectively. Other forming stations 9*c* to 9*j* in first forming group and the forming stations 10*a* to 10*j* in the forming group also have the similar stand structure with the forming stations 9*a* and 9*b* as shown by FIG. 6 which includes upper stand 33, upper roll holder 34, upper forming roll 35, lower forming roll 36, lower roll holder 37 and lower stand 38. As the material to be formed, a coil or a flat strip having a desired braid width may be employed. The coil may be subjected to pass through an uncoiler and then sent into the forming apparatus. In a case where specified length steel plates are used as braid material, each piece thereof is put into the pinch rolls by means of a proper feeding apparatus.

Figure 1:
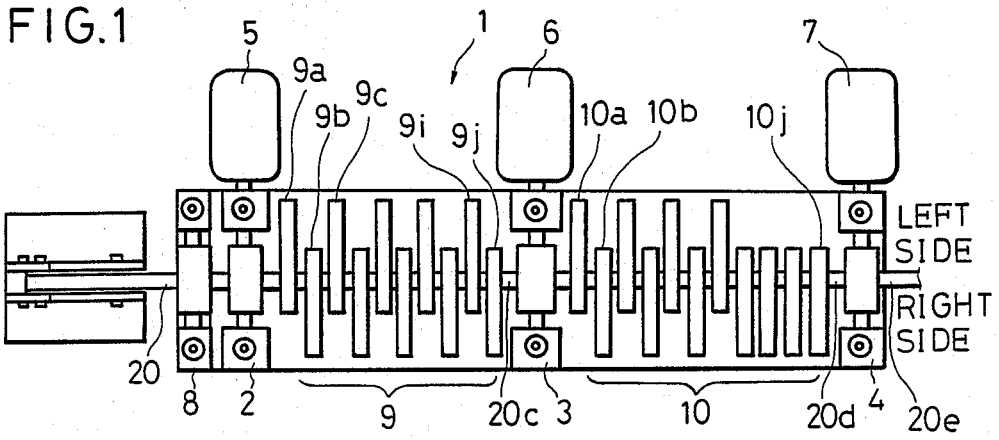
FIG. 1 shows a front view of a roll forming apparatus.
Figure 2:
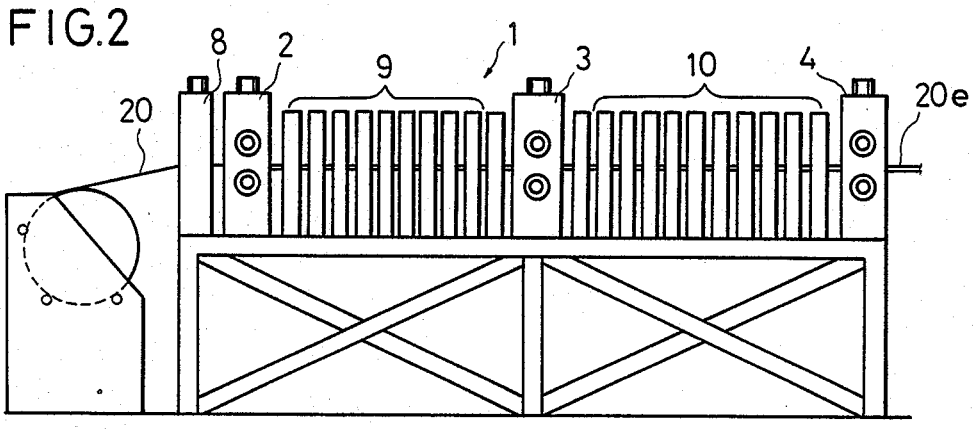
FIG. 2 is a side view thereof.
Figure 3:
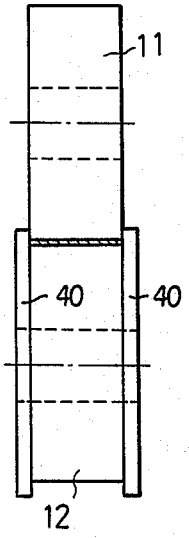
FIG. 3(A) shows a pair of pinch rolls.
FIG. 3(B) shows a pair of first driving rolls.
FIG. 3(C) shows a pair of second driving rolls.
FIG. 3(D) shows a pair of third driving rolls.
Figure 3:
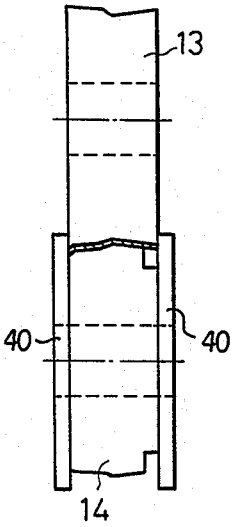
Figure 3:
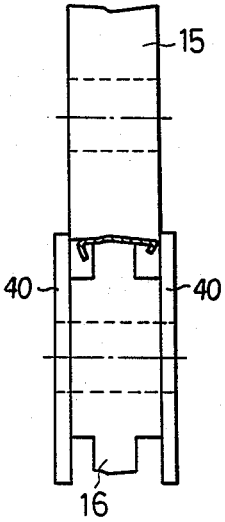
Figure 3:
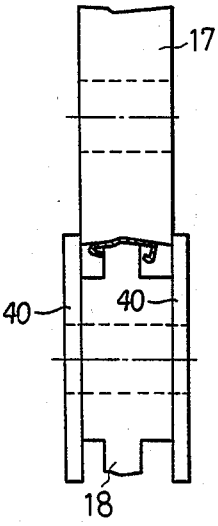

The bending procedure and bending behavior of the forming apparatus are described below. At first a thin steel strip 20 shown in FIG. 1 is set to pass through the pinch rolls 11, 12 guided by guides 40, 40, the first driving rolls 13, 14, the second driving rolls 15, 16 and finally through the third driving rolls 17, 18. Then the forming stations 9*a* to 9*j* and 10*a* to 10*j* are set. At first, each interval spaced between a pair of the forming rolls of each respective forming station is wide. Then the first, second and third motors 5, 6, 7 are rotated synchronously, which drive the first, second and third driving stations. Here, the third motor 7 is rotating a little more rapidly than the second motor 6, and the second motor 6 is rotating a little more rapidly than the first motor 5. Thus the strip 20 is driven while having applied thereto a constant tensile strength between the third driving station 4 and the second driving station 3, and between the second driving station 3 and the first driving station 2. While the strip 20 is driven in this state, each space between a pair of forming rolls of a respective forming station is adjusted so that the strip is formed at each forming station. When forming rolls of all forming stations are adjusted, the speed of forming the strip is increased to successively form the strip. The pinch roll station 8 acts as a guide to prevent the strip from snaking. The middle portion of the strip 20 is shaped in a curve at the first driving station, while the strip 20 is guided. Both side portions of the strip 20 are bent alternatively at the first forming station group 9, wherein the side portions are respectively curved at an angle of 10 or more degrees. Similarly, at the second forming station group 10, the side portions of the strip are respectively bent at an angle of 10 and several degree.

The strip is driven by the pair of rolls 17, 18 of the third driving station, thereby the formed strip is reshaped.

The rotating speed of the motors 5, 6, 7, is preferably controlled with a computer, which drives respectively the first, second and third driving stations. Also it is prefered to control the adjustment of the pair of rolls of the forming station with a computer, such as the interval spaced between each rolls.

Obviously, numerous modifications and variations of the present invention are possible in light of the above teachings. It is therefore to be understood that within the scope of the appended claims, the invention may be practiced otherwise than as specifically described herein.

What is claimed is:

1. A roll forming apparatus for forming flat strip material to a channel shape, comprising:

a base member;

a first driving station fixed on the base member and containing a pair of driving rolls which drive the flat strip at a constant speed;

a second driving station spaced from the first driving station and fixed on the base member and containing a pair of driving rolls for pulling the strip at a higher speed than the first driving station so as to apply a tensile stress to the portion of strip between the first and second driving stations; and at least first and second forming stations set on the base member and provided between the first and second driving stations and alternately disposed in a longitudinal direction of the flat strip, each of said forming stations having a pair of driven and forming rolls which forms the strip, one of said pair of forming rolls having a convex V-shape cross-section and the other of said pair of forming rolls having a concave cross-section counter to said convex V-shape cross-section;

at least one of the driving rolls having a pair of guide portions which guide opposite side ends of the strip.

2. A roll forming apparatus according to claim 1, wherein said forming stations are divided into two groups on right and left side forming stations in a longitudinal direction, wherein said right forming stations form a right peripheral portion of the strip and said left forming stations form a left peripheral portion of the strip.

3. A roll forming apparatus according to claim 1, wherein the two forming stations further comprise a first forming station which forms a peripheral portion of the strip and a second forming station which forms a peripheral portion of the strip.

4. A roll forming apparatus according to claim 1, wherein at least one pair of the driving rolls further comprises a pair of forming and driving rolls.

5. A roll forming apparatus according to claim 1, which further comprises a third driving station spaced from the second driving station and fixed on the base member and containing a pair of driving rolls which pull the strip at a higher speed than that of the second driving station and further comprising third and fourth forming stations provided between the second and third driving stations wherein each of said third and fourth forming stations includes a pair of driven and forming rolls for forming the strip.

* * * * *